US010953264B2

(12) United States Patent
Towley, III

(10) Patent No.: US 10,953,264 B2
(45) Date of Patent: Mar. 23, 2021

(54) DUMBBELL HANDLE HAVING A DISLODGEMENT PREVENTING INTERFACE WITH THE WEIGHT SELECTOR OF A SELECTORIZED DUMBBELL

(71) Applicant: Carl K. Towley, III, Sebastian, FL (US)

(72) Inventor: Carl K. Towley, III, Sebastian, FL (US)

(73) Assignee: PowerBlock Holdings, Inc., Owatonna, MN (US)

( * ) Notice: Subject to any disclaimer, the term of this patent is extended or adjusted under 35 U.S.C. 154(b) by 0 days.

(21) Appl. No.: 16/186,048

(22) Filed: Nov. 9, 2018

(65) Prior Publication Data

US 2020/0147440 A1 May 14, 2020

(51) Int. Cl.
*A63B 21/075* (2006.01)
*A63B 21/072* (2006.01)

(52) U.S. Cl.
CPC ..... *A63B 21/075* (2013.01); *A63B 21/0726* (2013.01)

(58) Field of Classification Search
CPC ..... A63B 21/075; A63B 21/0726; A63B 21/072–0728
See application file for complete search history.

(56) References Cited

U.S. PATENT DOCUMENTS 5,769,762 A * 6/1998 Towley ..... A63B 21/0605 482/107
6,228,003 B1 * 5/2001 Hald ..... A63B 21/0728 482/107
6,322,481 B1 * 11/2001 Krull ..... A63B 21/0728 482/106
7,887,469 B1 * 2/2011 Chen ..... A63B 21/075 482/107
8,012,069 B2 * 9/2011 Towley, III ..... A63B 21/075 482/107
2002/0055426 A1 * 5/2002 Krull ..... A63B 21/0728 482/98
2002/0183174 A1 * 12/2002 Chen ..... A63B 21/075 482/108
2003/0114276 A1 * 6/2003 Schiff ..... A63B 21/0728 482/93
2004/0005969 A1 * 1/2004 Chen ..... A63B 21/075 482/107
2004/0162197 A1 * 8/2004 Towley, III ..... A63B 21/0605 482/107

(Continued)

*Primary Examiner* — Nyca T Nguyen
(74) *Attorney, Agent, or Firm* — James W. Miller

(57) ABSTRACT

A selectorized dumbbell has a handle that comprises a selector receiver and a hand grip that are separated from one another to allow a weight selector to be installed in the selector receiver. The position of the weight selector in the selector receiver determines how many of a plurality of nested weights are joined to the handle to thereby select the exercise mass of the dumbbell. After the weight selector is so installed, the hand grip is dropped into the selector receiver and is joined thereto by a connector so that the selector receiver and hand grip then act as a unitary handle to permit exercise with the selected number of weights. When so installed, the hand grip telescopically fits into the weight selector to affirmatively prevent the weight selector from inadvertently dislodging.

19 Claims, 9 Drawing Sheets

(56) References Cited

U.S. PATENT DOCUMENTS

2005/0233873 A1* 10/2005 Chen ..... A63B 21/075 482/107
2006/0240958 A1* 10/2006 Liu ..... A63B 21/0728 482/107
2007/0087918 A1* 4/2007 Towley, III ..... A63B 21/075 482/107
2007/0184945 A1* 8/2007 Lin ..... A63B 21/075 482/107
2008/0070761 A1* 3/2008 Lin ..... A63B 21/0728 482/107
2008/0146420 A1* 6/2008 Chen ..... A63B 21/0728 482/108
2008/0188362 A1* 8/2008 Chen ..... A63B 21/075 482/107
2009/0036278 A1* 2/2009 Towley, III ..... A63B 21/075 482/107
2010/0190618 A1* 7/2010 Chen ..... A63B 21/0728 482/108
2011/0028285 A1* 2/2011 Towley, III ..... A63B 21/0728 482/108
2011/0312475 A1* 12/2011 Towley, III ..... A63B 21/0726 482/107
2012/0021877 A1* 1/2012 Lundquist ..... A63B 21/0728 482/107
2012/0220434 A1* 8/2012 Lien ..... A63B 21/0726 482/108
2012/0264575 A1* 10/2012 Towley, III ..... A63B 21/00065 482/107
2012/0309597 A1* 12/2012 Liu ..... A63B 21/0726 482/107
2013/0165300 A1* 6/2013 Richards ..... A63B 21/0724 482/106
2014/0274597 A1* 9/2014 Towley, III ..... A63B 21/075 482/108
2017/0209731 A1* 7/2017 Towley, III ..... A63B 21/0726

* cited by examiner

DUMBBELL HANDLE HAVING A DISLODGEMENT PREVENTING INTERFACE WITH THE WEIGHT SELECTOR OF A SELECTORIZED DUMBBELL

TECHNICAL FIELD

This invention relates to exercise equipment and, more particularly, to a selectorized dumbbell having a user selectable exercise mass that is adjustable by selectively varying the position of a weight selector relative to a handle of the dumbbell. This invention further relates to a weight selector and a handle of the dumbbell that interface with one another in a manner that prevents unintended dislodgement of the weight selector.

BACKGROUND OF THE INVENTION

U.S. Pat. No. 5,637,064 to Towley et al, which is assigned to the assignee of this invention, discloses an existing selectorized dumbbell that is known as the PowerBlock®. In this dumbbell, there are a plurality of nested weights each of which comprises a left weight plate and a right weight plate that are joined together by a pair of front and rear rails. The left and right weight plates of the nested weights are disposed in nested left and right weight plate stacks that are spaced apart from one another by the length of the front and rear rails. The rails of each successively nested weight are longer and lower than the rails of the weight immediately to the inside to allow the weights to be nested together in the aforementioned manner.

The selectorized dumbbell disclosed in the 064 patent includes a handle that is dropped down into the gap between the left and right weight plate stacks. The handle has a pair of planar ends that are spaced apart from one another but are rigidly joined to one another by a central hand grip that extends between the ends and is affixed thereto. Each end of the handle includes a vertical array of outwardly facing, substantially horizontally extending slots. The various slots in the array are vertically spaced from one another such that one slot is below each of the rails.

A weight selector comprising a U-shaped connecting pin having a pair of spaced, parallel connecting prongs is provided. The prongs of the connecting pin are insertable into the pair of slots beneath the rails of a selected one of the nested weights. When the user then lifts the handle, the handle will carry with it the selected weight and all of the nested weights whose rails lie above the rail of the selected weight. Thus, the user can easily adjust the total weight carried by the handle simply by repositioning the connecting pin from one pair of slots to another.

The use of an insertable pin is an effective weight selector for a selectorized dumbbell. However, while it is unlikely to happen, it is possible for a user to incorrectly install the U-shaped connecting pin by inserting one connecting prong on one side of the pin beneath the rails of the selected weight and the other connecting prong on the other side of the pin beneath the rails of the weight either above or below the selected weight. This is called cross-pinning. Since the weights are not correctly held in their most stable configuration when they are cross-pinned, there is a small possibility of damage or failure of the connecting pin and consequent dislodgement of the weights from the handle.

In addition, prior connecting pins of the type described above have incorporated magnets that are magnetically attracted to the rail to which the cross member of the connecting pin is adjacent when the connecting pin is correctly installed in the pair of slots beneath the rails of a selected one of the nested weights. This magnetic attraction is strong enough to form a magnetic latch that holds the connecting pin in place when the user is exercising with the dumbbell. However, the use of magnets increases the manufacturing cost of the connecting pin and increases the danger of disconnection in a cross-pinned situation since the cross member of the connecting pin no longer lies flush against a single rail. In addition, even when the connecting pin is correctly installed and the magnetic latch formed by the magnets is in place, very vigorous exercise in certain instances can very rarely overcome the magnetic attraction to cause the connecting pin to begin to detach from the handle.

U.S. Pat. No. 10,010,742 to Towley, III, which is assigned to the assignee of this invention, discloses an improved weight selector in which the traditional U-shape of the selector is replaced by a more completely enclosed shape having a substantially continuous periphery that substantially encloses an open interior. The ends of the handle are modified so that the slots face inwardly rather than outwardly as in the '064 patent. When the selector with the substantially continuous periphery is slid into a selected pair of slots in the handle ends, the user is able to reach down through the open interior and grab the hand grip of the handle in order to use the dumbbell during exercise.

This type of selector has various advantages over the prior U-shaped selector. First, the presence of the fourth side prevents the selector from being cross-pinned. Secondly, since the fourth side of the selector is continuous enough, i.e. substantially continuous as described in the '742 patent, the fourth side of the selector helps prevent inadvertent dislodgement of the selector. Should the selector tend to slide out of the selected pair of slots while the user is exercising, the fourth side of the selector will engage against whatever portion of the user's hand, wrist or forearm is at the same level as the selected pair of slots in which the selector is received. This engagement prevents complete disengagement of the selector, alerts the user to the fact that the selector is attempting to disengage, and provides the user with the opportunity to stop exercising while he or she resets the selector to its fully engaged position. Accordingly, a selectorized dumbbell having the selector disclosed in the '742 patent is well suited for use in every setting.

Despite these advantages, such a selector decreases the range of weight adjustability that is possible from a selectorized dumbbell of the same size since the sets of slots that receive the selector must be positioned to avoid interference with the hand grip. For example, if the selector is made of a substantially rigid material as is desirable for strength, one cannot couple the same number of weights to the handle as one previously could since fewer sets of slots can be used on the handle. Alternatively, it would be possible to use curved slots and a flexible selector as also shown in the '742 patent such that the some slots curve up and around the hand grip while other slots curve down and below and around the hand grip. While this slightly increases the number of weights that can be coupled to the handle compared to a rigid selector, such a flexible selector has less strength. Accordingly, it would be desirable to find a way to retain the no cross-pinning and safety aspects of the selector of the '742 patent without decreasing the number of weights that can be coupled to the handle or sacrificing strength in the selector. This invention is directed in part to solving this problem.

In traditional PowerBlock® dumbbells, the cross member of the U-shaped connecting pin has a thickness that is greater than the vertical distance between the rails of a pair of adjacent weights. Stands are sold for racking and supporting a pair of such dumbbells in a closely spaced side-by-side manner. When so racked, it is intended that the cross members on the connecting pins face outwardly. This allows a user to reach each cross member from the exposed side of each dumbbell to make weight adjustments on one or both of the dumbbells without having to move the dumbbells from their racked position on the stand.

However, when a user is done exercising with one or both of the dumbbells and places the dumbbells back on the stand, it sometimes happens that the user reracks the dumbbells incorrectly on the stand with at least one of the cross members facing inwardly rather than outwardly. When the next user approaches the dumbbell pair resting on the stand, he or she finds that any connecting pin having an inwardly facing cross member cannot be pulled out and reinserted into a different weight selection position as there is no room to do so without the inwardly facing cross member hitting the adjacent dumbbell. This forces the next user to first reposition the incorrectly racked dumbbell on the stand so that the cross members on both connecting pins face outwardly in order to be able to reach the cross members to properly change the weight selections as the dumbbells rest on the stand. However, some users find it difficult to accomplish such repositioning particularly when the previous user, namely the user who had incorrectly racked the dumbbells on the stand, had selected a heavy weight setting on each dumbbell. This is obviously a disadvantage.

SUMMARY OF THE INVENTION

One aspect of this invention relates to a selectorized dumbbell which comprises a plurality of nested weights that provide a stack of left weight plates and a stack of right weight plates. A handle is located between the weight plate stacks. The handle comprises a selector receiver, a hand grip that is separate from the selector receiver, and a securing structure for selectively and releasably joining the selector receiver and the hand grip together to act as a unit. At least one weight selector is provided that is movable into one selected position chosen from among a plurality of different possible positions on the selector receiver to thereby couple a selected number of the weights to the handle. In addition, the hand grip and the at least one weight selector have an abutting interface therebetween that prevents dislodgement of the at least one weight selector from the selector receiver after the at least one weight selector is placed into the one selected position on the selector receiver and the hand grip is subsequently joined to the selector receiver by selective operation of the securing structure.

BRIEF DESCRIPTION OF THE DRAWINGS

This invention will be described more completely in the following Detailed Description, when taken in conjunction with the following drawings, in which like reference numerals refer to like elements throughout.

DETAILED DESCRIPTION

One embodiment of a selectorized dumbbell according to this invention is illustrated generally as 2. Dumbbell 2 is of the type disclosed in the Applicant's prior U.S. Pat. Nos. 5,637,064, 7,775,947 and 10,010,742, which are hereby incorporated by reference.

Figure 1:
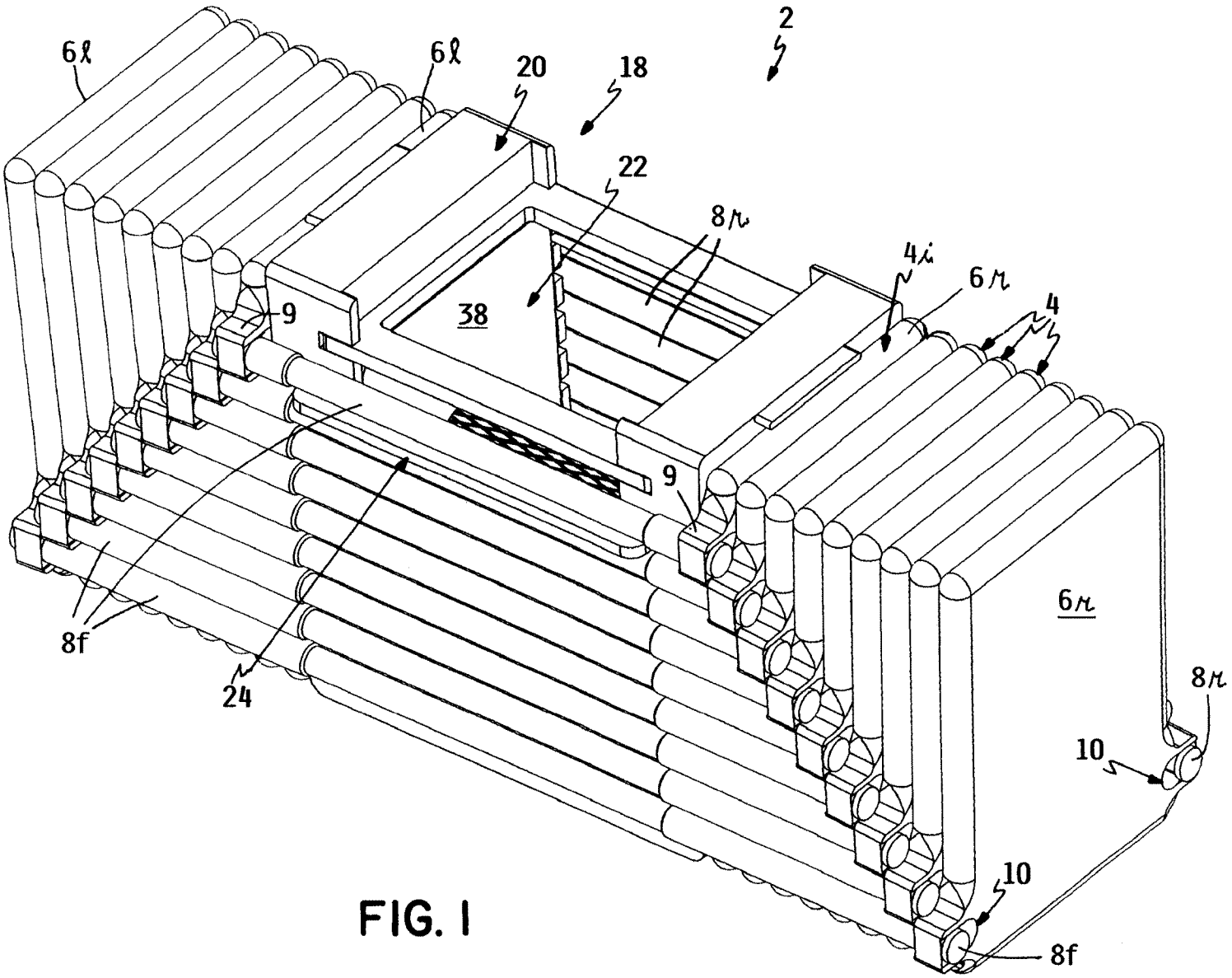
FIG. 1 is a perspective view of one embodiment of a selectorized dumbbell according to this invention, particularly illustrating the dumbbell in an assembled form after a weight selection has been made by the user but before the user has lifted the handle out of the nested weights to begin exercise with the selected number of weights.
Figure 2:
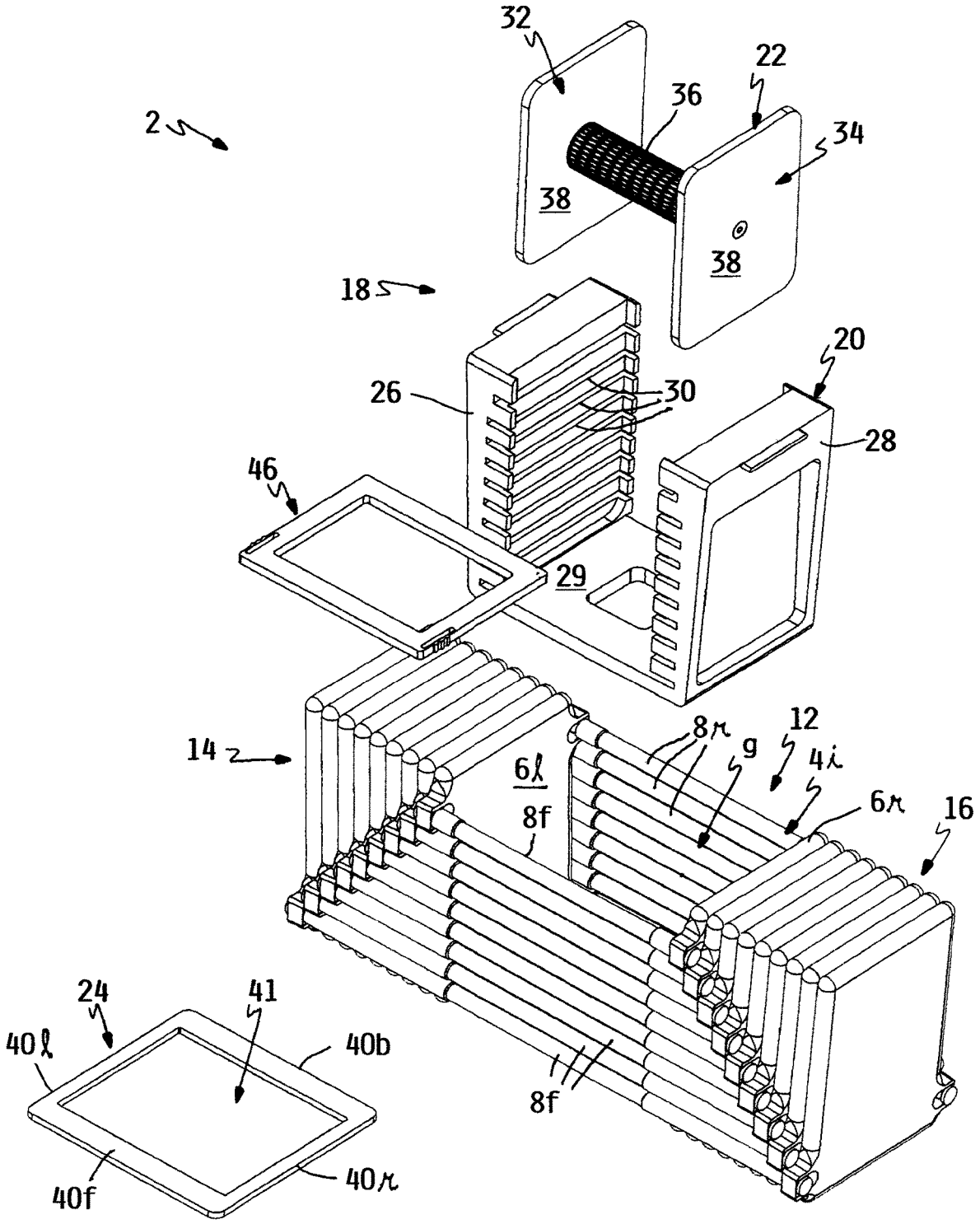
FIG. 2 is an exploded perspective view of the dumbbell of FIG. 1.

Referring first to FIGS. 1 and 2, dumbbell 2 includes a plurality of nested weights 4 from which the user may select a desired number to establish or set the exercise mass of dumbbell 2. Each weight 4 has the same basic structure as every other weight 4. The structure of each weight 4 comprises a left weight plate 6*l*, a right weight plate 6*r* that is spaced from left weight plate 6*l*, a substantially horizontal front connecting member 8*f* that is fixed at opposite ends thereof to small vertical portions of or to small outwardly projecting lugs 9 on the front edges of weight plates 6, and a similar back connecting member 8*b* that is similarly fixed to the rear edges of weight plates 6 at the same vertical elevation as front connecting member 8*f*.

Various connections may be used to fix connecting members 8 to weight plates 6, e.g. a rigid welded connection as disclosed in the '064 patent, or a flexible connection made using a releasable fastener and a flexible lug as disclosed in the '947 patent, or a keyhole type, snap fit connection of the type disclosed in the Applicant's U.S. Patent Application Publication 2018-0140888 which is also hereby incorporated by reference. Whatever connection is used, weight plates 6 and connecting members 8 of any given weight once connected act as an integral unit without weight plates 6 and connecting members 8 becoming disassembled from one another under ordinary use of dumbbell 2. In dumbbell 2 of this invention as shown in FIG. 1, the keyhole type, snap fit connection 10 of the '888 Publication is shown by way of illustration only and not by way of limitation.

While weights 4 all have the same basic structure, each weight 4 differs from every other weight in terms of its length and the vertical elevation of connecting members 8 thereon. The innermost weight denoted as 4*i* in FIGS. 1 and 2 has the shortest length and the highest connecting members 8. Each weight 4 that is located progressively further outside of innermost weight 4*i* has a progressively longer length and progressively lower and longer connecting members 8. As shown in FIG. 2, this allows the entire set of weights 4 to be nested together in an elongated horizontal stack 12 comprised of a stack 14 of nested left weight plates 6*l* immediately adjacent to one another, a stack 16 of nested right weight plates 6*r* immediately adjacent to one another, and a gap g that separates left and right weight plate stacks 14, 16 from one another. When all weights 4 are nested together in this manner, the front and back connecting members 8*f* and 8*b* form two identical arrays on the front and rear sides of weight stack 12 with each connecting member 8 in each array having a small vertical space below it. Gap g between left and right weight plate stacks 14, 16 is long enough and wide enough to accommodate a handle 18 of dumbbell 2 therein as will now be described.

Handle 18 of dumbbell 2 comprises a selector receiver 20 and a hand grip 22 that may be assembled and disassembled relative to one another. When assembled, handle parts 20, 22 are operatively joined together to act as a unitary handle to allow the user to exercise with a selected number of weights being coupled to handle 18. When disassembled, handle parts 20, 22 are capable of being separately manipulated from each other to first permit a weight selector 24 to be installed in selector receiver 20. Once this is accomplished, hand grip 22 can be operatively joined to selector receiver 20 with hand grip 22 when so joined interfacing with weight selector 24 to prevent inadvertent dislodgement of weight selector 24 during subsequent exercise by a user with dumbbell 2.

In one embodiment of handle 18, selector receiver 20 is U-shaped having a left end 26, a right end 28 that is spaced from left end 26, and an interconnecting bottom 29. Each end 26, 28 of selector receiver 20 has an array of vertically spaced slots 30 that run horizontally between the front and rear sides of each end 26, 28 of selector receiver 20. Slots 30 open inwardly through the inside surfaces of ends 26, 28 of selector receiver 20.

The number of slots 30 in each array in each end 26, 28 of selector receiver 20 is the same and corresponds to the number of nested weights 4 in weight stack 14. Each slot 30 in each array lies below a different connecting member 8 in the nested weights 4. Thus, with respect to the front and back connecting members 8*f* and 8*b* of any given weight 4, a pair of slots 30, i.e. slot 30 in left end 26 of selector receiver 20 and the same corresponding slot 30 in right end 28 of selector receiver 20, will lie below front and back connecting members 8*f* and 8*b*. In addition, left and right ends 26, 28 of selector receiver 20 and slots 30 carried therein are long enough such that opposite ends of slots 30 lie directly underneath the front and back connecting members 8*f*, 8*b* of the given weight 4.

Turning now to the second part of handle 18, one embodiment of hand grip 22 is H-shaped having a left end wall 32, a right end wall 34 spaced from left end wall 32, and an interconnecting elongated tubular grip member 36. In one embodiment, the left and right end walls 32, 34 of hand grip 22 comprise similarly sized and shaped plates 38. Grip member 36 has its opposite ends affixed to plates 38 in any suitable manner, e.g. by a welded connection, a bolted or screwed connection, or the like. When so interconnected, the left and right end walls 32, 34 and grip member 36 which together form hand grip 22 comprise a unitary assembly which is manipulated by the user by holding grip member 36 with one hand to lift and lower hand grip 22.

Turning now to weight selector 24 that is used to select how many nested weights 4 are coupled to handle 18, one embodiment of weight selector 24 may comprise the four sided weight selector disclosed in the '742 patent. In this form, weight selector 24 is shaped as a four sided polygon, such as a square or rectangle, having straight sides. Thus, weight selector 24 has a substantially continuous periphery which is formed by a pair of parallel, spaced, left and right side walls 40*l* and 40*r*, respectively, which are joined together by a pair of parallel, spaced, front and rear walls 40*f* and 40*r*, respectively. Consequently, weight selector 24 is shaped like a four sided picture frame with the area inside the frame comprising an open interior 41 of weight selector 24.

Figure 3A:
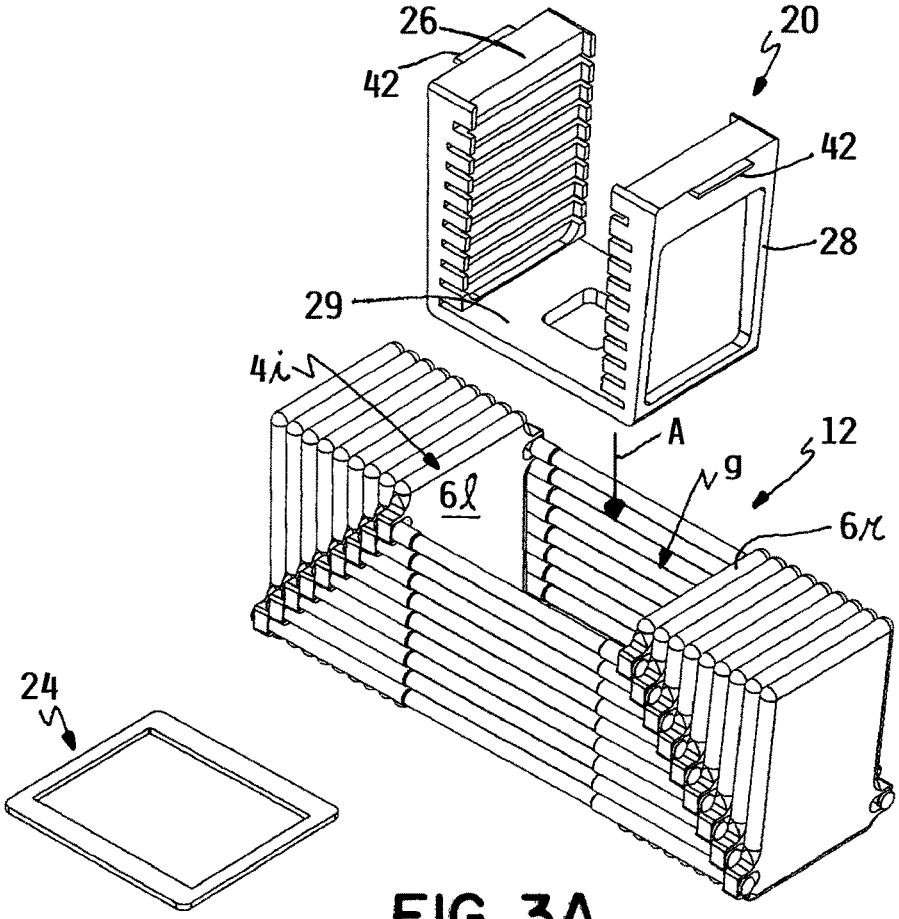
FIGS. 3A-3F are perspective views the illustrate the method of performing a weight selection.
Figure 3B:
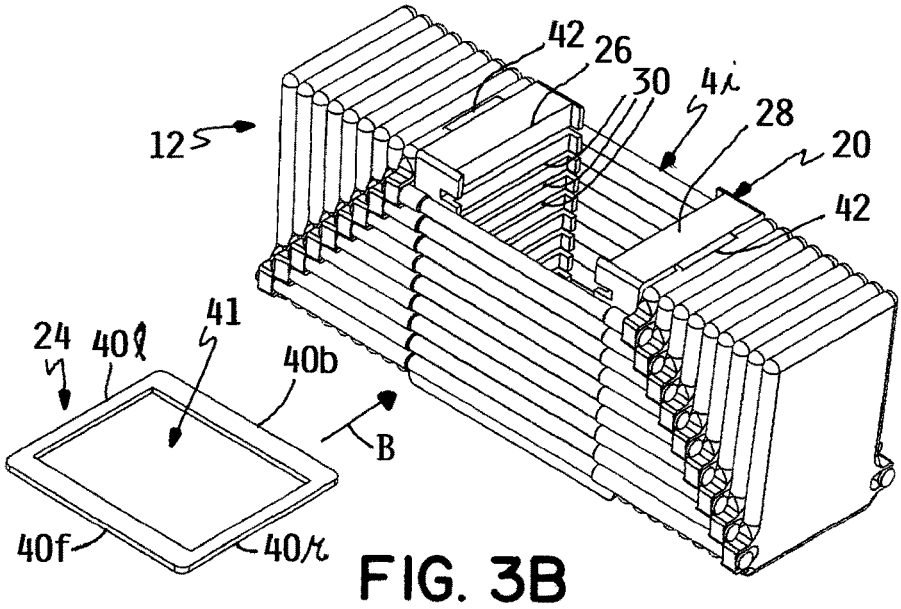

Referring now to FIGS. 3A-3F, in selecting how many weights 4 are coupled to handle 18 for use in doing exercises with dumbbell 2 and assuming that selector receiver 20 is not already positioned within gap g in horizontal weight stack 12, the user first positions selector receiver 20 of handle 18 above weight stack 12 and aligns selector receiver 20 with central gap g in weight stack g. See FIG. 3A. When weight stack 12 is lying on a planar support surface, such as the surface of a support stand or on a floor, the user will then lower or drop selector receiver 20 of handle 18 down into the gap g in the direction of arrow A in FIG. 3A until bottom 29 of selector receiver 20 comes to rest on the same support surface on which weight stack 12 rests as shown in FIG. 3B. When selector receiver 20 is fully inserted into gap g as shown in FIG. 3B, two outwardly extending tabs 42 at the top of left and right ends 26, 28 of selector receiver 20 will also engage against and lie atop the upper edges of the left and right weight plates 6*l* and 6*r* of innermost weight 4*i*. The engagement of tabs 42 and the fact that selector receiver 20 and weight stack 12 are lying on the same support surface vertically aligns selector receiver 20 relative to weight stack 12. When so aligned, each corresponding pair of slots 30 in left and right ends 26, 28 of selector receiver 20 will be positioned immediately below the front and back connecting members 8*f*, 8*b* of one particular weight 4.

Figure 3C:
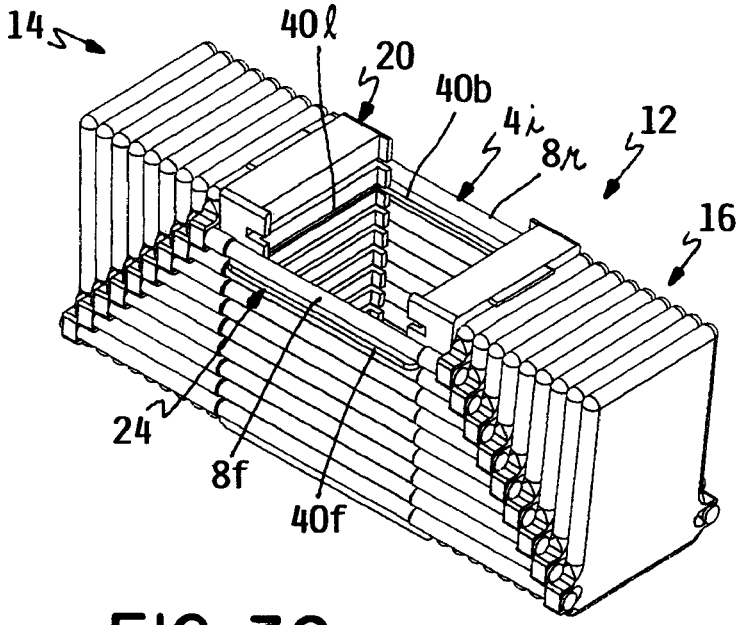

The user can then make a determination about how many weights he or she wishes to use during exercise. By way of example and assuming the user wishes to exercise with only one weight, namely innermost weight 4*i*, the user will grip front wall 40*f* of weight selector 24 and horizontally align weight selector 24 with the uppermost pair of slots 30 in selector receiver 20. The user will then slide the left and right side walls 40*l*, 40*r* of weight selector 24 horizontally into the pair of uppermost left and right slots 30 in selector receiver 20 as shown by the arrow B in FIG. 3B until weight selector 24 is fully inserted. When fully inserted, the front and rear ends of right and left side walls 40*l*, 40*r* of weight selector 24 will underlie the front and back connecting members 8*f* and 8*b* of the innermost weight 6*i* in weight stack 12 as shown in FIG. 3C. Thus, when handle 18 is fully assembled as will be described hereafter and when the user lifts handle 18 to exercise with dumbbell 2, handle 18 will carry with it innermost weight 4*i* in weight stack 12.

To couple additional weights to handle 18, the user simply inserts weight selector 24 into a lower pair of slots 30 in selector receiver 20. When handle 18 is then lifted by the user, handle 18 will bring with it the selected weight 4 whose connecting members 8 lie immediately above weight selector 24 together with all the weights 4 whose connecting members 8 lie above the connecting members 8 of the selected weight. The higher the pair of slots 30 which receives weight selector 24, the fewer the number of weights 4 coupled to handle 18. The lower the pair of slots 30 which receives weight selector 24, the greater the number of weights 4 coupled to handle 18. Since there are nine nested weights 4 in the embodiment of dumbbell 2 shown herein, there are nine pairs of slots 30 in weight selector 20.

Weight selector 24 can be a simple flat selector having a constant thickness as shown in FIGS. 3A-3B. As shown in FIG. 3C, the thickness of weight selector 24 is less than the vertical distance between the front and back connecting members 8*f*, 8*b* of any given pair of adjacent weights 4. This allows weight selector 24 to be received in the interstitial spaces between the connecting members 8*f*, 8*b* of one weight 4 and the connecting members 8*f* and 8*b* of the weight 4 immediately below the one weight 4 or between the lowermost connecting members 8*f*, 8*b* and the bottom 29 of selector receiver 20 as the case may be.

Thus, even in a pair of dumbbells 2 that are racked side-by-side on a stand and prior to hand grip 22 being assembled in selector receiver 20 as best shown in FIG. 3C, the user has access to weight selector 24 from the interior of selector receiver 20. This allows the user to place one or more fingers into contact with either the front side 40*f* or the back side 40*b* of weight selector 24 as the case may be to first push on and to then later grip and pull weight selector 24 out of the pair of slots 30 in which it is currently received. These removal actions may be performed bi-directionally with the user simply choosing whatever direction is required to avoid the adjacent racked dumbbell 2 on the stand.

Accordingly, with a weight selector 24 of this design, a pair of dumbbells can never be incorrectly racked on a stand in a way that provides insufficient space in which to reach and remove weight selector 24. With hand grips 22 out of the way, each weight selector 24 in each dumbbell 2 in a pair of racked dumbbells 2 can always be reached and removed from the slots 30 in which it is currently received and can then be reinstalled in a different pair of slots 30 through whatever side of dumbbell 2 happens to be the outward side in a racked pair of side-by-side dumbbells. This avoids ever having to remove dumbbells 2 as they sit on top of a stand and reposition at least one of the dumbbells 2 on the stand just to make a different weight selection.

Alternatively, weight selector 24 can have a thicker front wall 40*f* which is easier to grip by the user both to manipulate weight selector 24 and to push weight selector 24 into place or to remove weight selector 24. The thicker front wall 40*f* of such a weight selector could form or have a pair of stops on the left and right sides with such stops abutting against the front faces of left and right ends 26, 28 of selector receiver 20 when weight selector 24 is fully inserted as disclosed in the '742 patent. In this form of weight selector 24, the user would simply grip the thicker front wall 40*f* of weight selector 24 and push it into the selected pair of slots 30 until weight selector 24 stops against the left and right ends 26, 28 of selector receiver 20 and weight selector 24 can be pushed no further inwardly. This type of weight selector 24 would relieve the user from having to manually judge how far to push weight selector 24 in and to stop such insertion by visually observing the moment when weight selector 24 is deemed to be fully inserted. However, such an alternative weight selector 24 would not have the racking advantages described in the preceding paragraph.

Figure 3D:
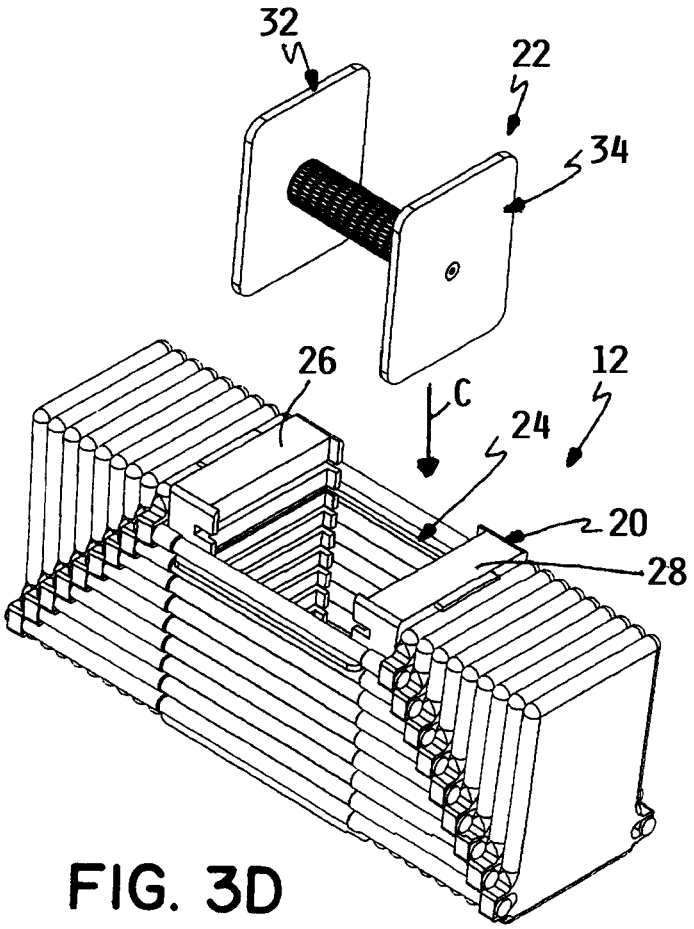

The weight selection process does not end with the insertion of weight selector 24 into a selected pair of slots 30 in selector receiver 20 of handle 18. The next step that is required is to insert hand grip 22 of handle 18 into selector receiver 20 following the insertion of weight selector 24 in selector receiver 20. Referring now to FIG. 3D, this is accomplished by the user by first aligning hand grip 22 with the upwardly open cavity defined between the left and right ends 26, 28 and bottom 29 of selector receiver 20. As shown in FIG. 3D hereof, this alignment orients grip member 36 of hand grip 22 perpendicularly to left and right ends 26, 28 of selector receiver 20 and with hand grip 22 also being centered above weight stack 12.

Figure 4:
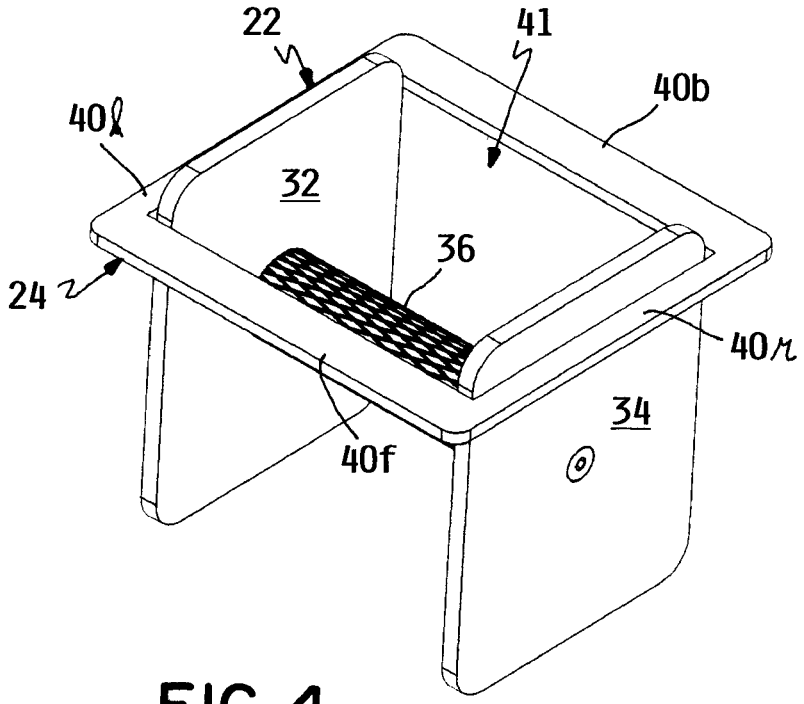
FIG. 4 is a perspective view of a portion of the dumbbell of FIG. 1, particularly illustrating the dislodgement preventing interface between the weight selector and the hand grip of the handle.

After this alignment of hand grip 22, the user need only lower hand grip 22 of handle 18 in the direction of arrow C in FIG. 3D down into selector receiver 20 until left and right end walls 32, 34 of hand grip 22 rest atop bottom 29 of selector receiver 20. When so inserted, left and right end walls 32, 34 of hand grip 22 are sized and shaped to be received within open interior 41 of weight selector 24 substantially adjacent to but inboard of the inside surfaces of left and right side walls 40*l*, 40*r* of weight selector 24 or of the inside surfaces of left and right ends 26, 28 of selector receiver 20, whichever surfaces lie innermost. In addition, the front and rear edges of left and right end walls 32, 34 of hand grip 22 are spaced apart far enough to be substantially adjacent to but inboard of the inside surfaces of front and rear walls 40*f*, 40*r* of weight selector 24. In this context, "substantially adjacent to" means a space that is large enough to facilitate insertion of hand grip 22 but small enough to prevent substantial play between hand grip 22 and selector receiver 20 and weight selector 24, e.g. a space of approximately 0.015 inches or less. This space results in hand grip 22 being received within open interior 41 of weight selector in a close side-to-side and front-to-back fit as best shown in FIG. 4.

Figure 3E:
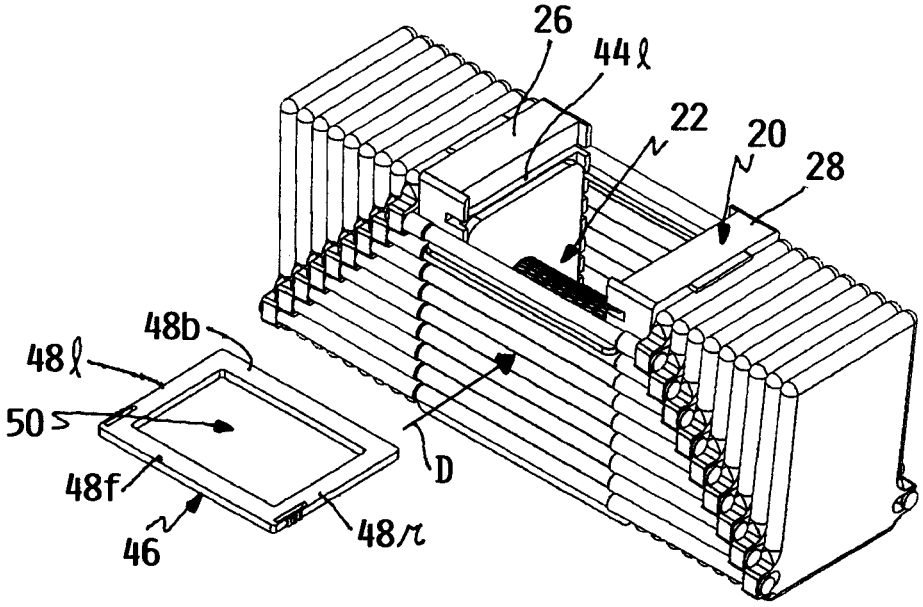
Figure 3F:
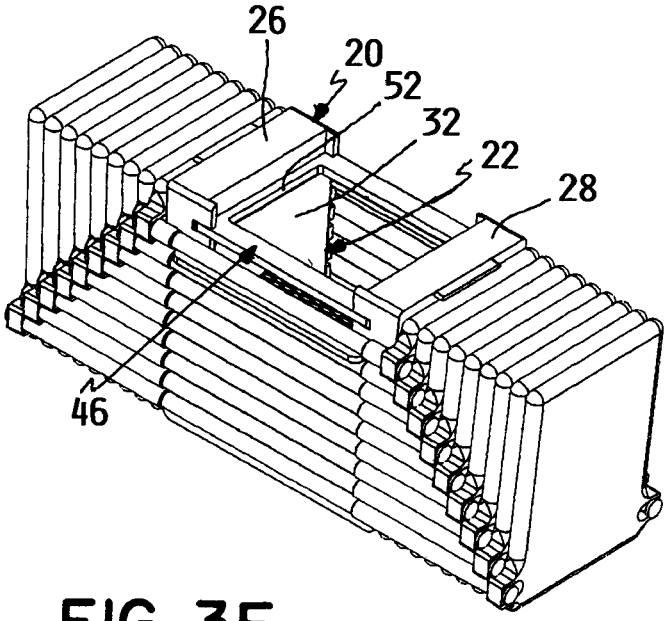

Since the width of left and right side walls 40*l*, 40*r* of weight selector 24 are preferably substantially the same as the width of slots 30 in selector receiver 20 in which side walls 40*l*, 40*r* are received, the inside surfaces of left and right side walls 40*l*, 40*r* of weight selector 24 will lie substantially in the same vertical plane as the inside surfaces of left and right ends 26, 28 of selector receiver 20. Thus, when hand grip 22 is fully inserted into selector receiver 20 as shown in FIG. 3E with left and right end walls 32, 34 of hand grip 22 being telescopically received within open interior 41 of weight selector 24 to be substantially adjacent to the inside surfaces of side walls 40*l*, 40*r* of weight selector 24, such end walls 32, 34 will be similarly substantially adjacent to the inside surfaces of left and right ends 26, 28 of selector receiver 20. Effectively, end walls 32, 34 of hand grip 22 will lie substantially flush against the inside surfaces of left and right ends 26, 28, respectively, of selector receiver 20 subject to the small "substantially adjacent to" spacing described above to cover the entire array of slots 30 in left and right ends 26, 28 of selector receiver 20. See FIGS. 3E and 4.

Though such spacing of hand grip 22 relative to selector receiver 20 is preferred for stability of handle 18 during exercise and for ease of securing selector receiver 20 to hand grip 22 as shown hereafter, it need not necessarily be the case. For example, weight selector 24 could have wider left and right side walls 40*l*, 40*r* as compared to the width of slots 30 such that open interior 41 of weight selector 24 is inset or inwardly spaced from the inside surfaces of left and right ends 26, 28 of selector receiver 20. In this event, the space between end walls 32, 34 of hand grip 22 is necessarily reduced to allow hand grip 22 to telescopically interfit within open interior 41 of weight selector 24 in a close fit though such end walls 32, 34 will then be positioned further away from the inside surfaces of left and right ends 26, 28 of selector receiver 20.

Once hand grip 22 of handle 18 is installed in selector receiver 20 of handle 18 as shown in FIG. 3E to thereby be capable of preventing dislodgement of weight selector 24, it is necessary to releasably but substantially immovably secure hand grip 22 to selector receiver 20 so that the secured parts act as a unitary handle 18. When so secured, hand grip 22 of handle 18 will be joined to selector receiver to be substantially rigid with or fixed to selector receiver 20 so that lifting or lowering hand grip 22 of handle 18 will bring with it the rest of dumbbell 2 including whatever number of nested weights 4 have been coupled by the user to selector receiver 20 of handle 18 through prior selective placement of weight selector 24 in selector receiver 20.

Referring now to FIGS. 3E-3F and FIGS. 6-7, an exemplary embodiment of a securing structure for securing hand grip 22 to selector receiver 20 comprises an upper pair of connection slots 44 in selector receiver 20. Slots 44 comprise an inwardly facing left slot 44*l* extending from front to back through an upper end of left end 26 of selector receiver 20 and an inwardly facing right slot 44*r* extending from front to back through an upper end of right end 28 of selector receiver 20. The two connection slots 44 are at the same vertical elevation as one another to form a corresponding single pair of slots like the vertically aligned pairs of slots 30 in which weight selector 24 is received. However, the pair of connection slots 44 is located in the left and right ends 26, 28 of selector receiver 28 above all of the pairs of slots 30 in selector receiver 20.

The structure for securing hand grip 22 to selector receiver 20 further includes a four sided connector 46 that is similar to weight selector 24. Like weight selector 24, connector 46 is shaped as a four sided polygon, such as a square or rectangle, having straight sides. Like weight selector 24, connector 46 has a substantially enclosed periphery which is formed by a pair of parallel, spaced, left and right side walls 48*l*, 48*b* which are joined together by a pair of parallel, spaced, front and rear walls 48*f*, 48*b*. Consequently, like weight selector 24, connector 46 is shaped like a four sided picture frame with the area inside the frame comprising an open interior 50 of connector 46.

Figure 7:
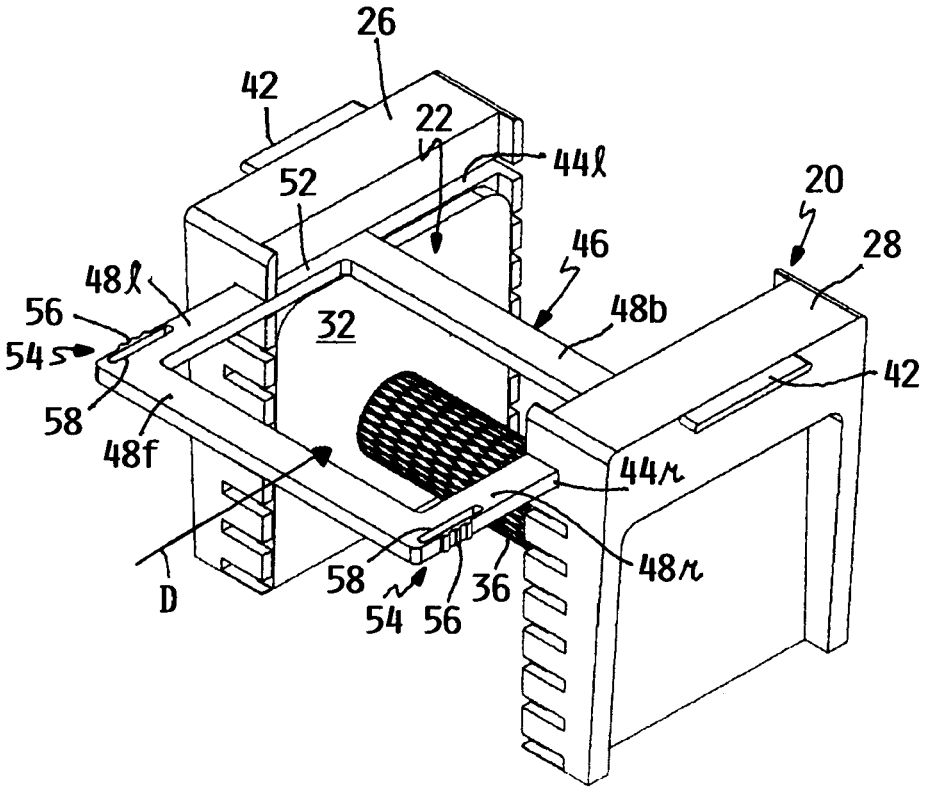
FIG. 7 is a perspective view of the securing structure shown in FIG. 6 with the bottom of the selector receiver being broken away and with the connector being shown partially installed.

After hand grip 22 of handle 18 has been dropped down into selector receiver 20 of handle 18 as shown in FIG. 3D, connector 46 may be slid into connection slots 44 adjacent the top of selector receiver 20 of handle 18. This is done by the user by gripping front wall 48*f* of connector 44 and sliding it inwardly into connection slots 44 in the direction of arrow D in FIG. 3E or FIG. 7. When so installed, the inside portions of left and right side walls 48*l*, 48*b* of connector 46 will protrude inwardly past the inside surfaces of left and right ends 26, 28 of selector receiver 20 to form retention lips 52. Retention lip 52 on left side wall 48*l* of connector 46 is best shown in FIG. 7 with retention lip 52 on right side wall 38*b* being hidden in FIG. 3E and FIG. 7.

Each retention lip 52 will have an exposed width substantially equal to the thickness of left and right end walls 32, 34 of hand grip 22 of handle 18. When connector 46 is fully installed, retention lips 52 directly cover and closely overlie left and right end walls 32, 34 of hand grip 22. Thus, hand grip 22 is secured to selector receiver 20 by having its end walls 32, 34 be substantially firmly captured or clamped between bottom 29 of selector receiver 20 and retention lips 52 on connector 46. See FIG. 3F. Thus, when the user subsequently holds onto grip member 36 of hand grip 22 and lifts upwardly on handle 18 following insertion of connector 46, the upward motion of hand grip 22 is transmitted to selector receiver 20 through connector 46 and the upper pair of connection slots 44 to thereby carry selector receiver 20 and any nested weights 4 that have been coupled thereto with hand grip 22.

Referring again to FIG. 7, the left and right side walls 48*l* and 48*b* of connector 46 can be provided with a friction retainer 54 at one end thereof. In one embodiment, friction retainer 54 can be formed by a plurality of outwardly facing serrated teeth 56 on an outside surface of each side wall 48*l* and 48*r*. Teeth 56 have a removed portion or slot 58 is provided in side wall 48*l* or 48*r* behind each set of teeth 56. The total distance between the tips of teeth 56 on the opposite side walls 48*l* and 48*r* of connector 46 is slightly greater than the total distance between the vertical side walls of slots 44. Thus, as the user pushes connector 46 inwardly with the portions of side walls 48*l* and 48*r* carrying teeth 56 finally entering slots 44 as full insertion is neared, the portions of side walls 48*l* and 48*r* carrying teeth 56 are free to flex inwardly due to the presence of slots 58 behind teeth 56. The resilience of the material out of which connector 46 is preferably made, e.g. a plastic molded connector 46, will bias teeth 56 outwardly into contact with the vertical side walls of slots 44 as the portions of side walls 48*l* and 48*r* carrying teeth 56 flex inwardly. This outward bias will result in teeth 56 having a frictional retaining force within slots 44 tending to lock or hold connector 46 in place.

The telescopic interfitting of hand grip 22 within open interior 41 of weight selector 24 after hand grip 22 is inserted down into selector receiver 20 effectively locks or retains weight selector 24 in place during exercise. If weight selector 24 attempts to slide out of whatever pair of slots 30 in which weight selector 24 is received, such sliding motion is almost immediately stopped by the rear edges of end walls 32, 34 of hand grip 22 abutting against the inside surface of rear wall 40*r* of weight selector 24 in case of a sliding motion of weight selector 24 in a forward direction, or by the front edges of end walls 32, 34 of hand grip 22 abutting against the inside surface of front wall 40*f* of weight selector 24 in case of a sliding motion of weight selector 24 in a rearward direction. Thus, weight selector 24 and hand grip 22 of handle 18 have an abutting interface that comes into play during exercise to affirmatively engage against weight selector 24 and thereby prevent weight selector 24 from sliding out of selector receiver 20 of handle 18 in those rare instances where weight selector 24 might tend to dislodge. With handle 18 in place, weight selector 24 cannot be removed, either accidentally or intentionally, from whatever pair of slots 30 carries weight selector 24. This would be an attractive feature to many potential purchasers of dumbbell 2.

Notably, the dislodgement preventing interface described above is accomplished without in any way compromising or reducing the number of nested weights 4 that can be coupled to handle 18. The same number of pairs of slots 30 is provided in selector receiver 20 as is found in a typical PowerBlock dumbbell of the same size since the number and placement of slots 30 need no longer avoid grip member 36 as it must do in the '742 patent. Moreover, there is no need to make weight selector 24 flexible so as to be received in curved slots as also shown in the '742 patent in order to try and increase the number of pairs of slots 30 that are provided. Instead, slots 30 can be straight and weight selector 24 can be rigid. Accordingly, dumbbell 2 according to this invention does not diminish how many nested weights 4 can be coupled to handle 18 or sacrifice strength and durability in weight selector 24.

In addition, since the user can only reach grip member 36 on hand grip 22 by reaching down through open interior 50 of connector 46, the four sides of connector 46 will surround the user's lower forearm, wrist or hand during use of dumbbell 2. Thus, should connector 46 tend to dislodge from connection slots 44 despite the presence of friction retainers 54, either the front wall 48*f* or the rear wall 48*b* of connector 46 will come into contact with the user's lower forearm, wrist or hand to alert the user to the fact that connector 46 is attempting to dislodge. Once so alerted, the user can stop exercising and reset connector 46 to its fully inserted position, thus retaining in connector 46 of dumbbell 2 the safety aspects previously associated with the weight selector of the '742 patent.

It is preferred that weight selector 24 have a continuous periphery around the four sides thereof as weight selector 24 will have maximum strength when so constructed. However, weight selector 24 can have a dislodgement preventing interface with hand grip 22 of handle 18 even if one of the front or rear walls 40*f*, 40*b* of weight selector 24 were non-continuous to have a gap, e.g. up to about three or four inches, in the middle thereof. Such a broken fourth wall would have partial width portions extending inwardly from the left and right side walls 40*l*, 40*r* with the partial width portions pointing towards one another but not meeting in the middle. In this broken fourth wall configuration, the partial width portions of the fourth wall must be long enough and strong enough to allow the front and rear edges of the left and right end walls 32, 34 of hand grip 22 to engage against the partial width portions without breaking or bending the partial width portions. Weight selector 24, whether having a continuous periphery with four unbroken walls 40 or a non-continuous periphery formed by a broken fourth wall 40*f* or 40*b*, can be made of metal, molded from a suitably hard, durable plastic, or made from a combination of metal and plastic such as where the partial width portions in the broken fourth wall configuration comprise metallic posts molded into a plastic forming the other three walls of weight selector 24.

Figure 8:
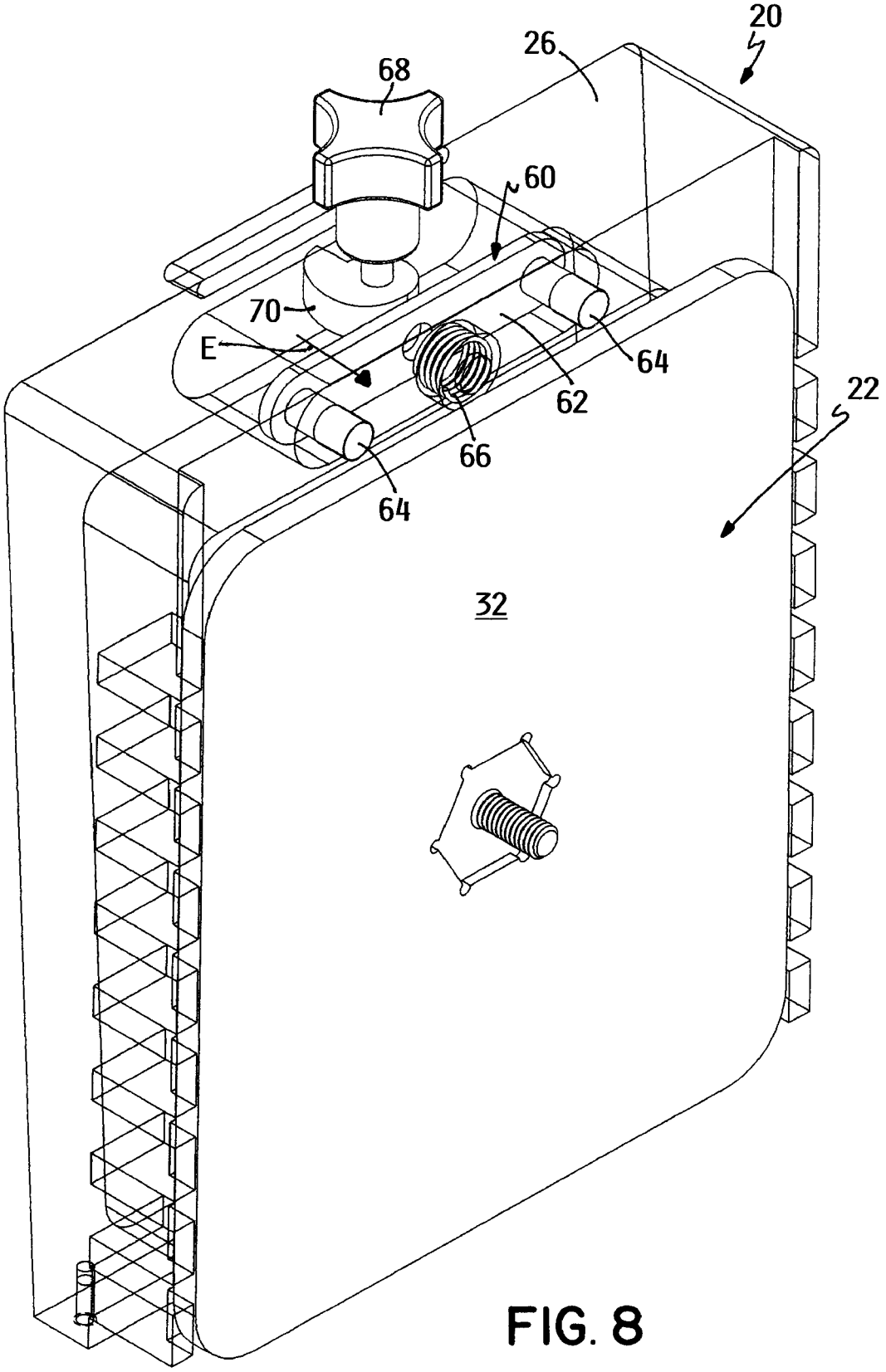
FIG. 8 is a perspective view of a second embodiment of a structure for securing the selector receiver and the hand grip of the handle together.

FIG. 8 discloses a second embodiment of the securing structure for joining hand grip 22 to selector receiver 20. In this alternative, each end 26, 28 of selector receiver 20 has an internal cavity at the top in which a U-shaped bail 60 is slidably received. Bail 60 has a base 62 that carries two inwardly projecting, laterally spaced retention members 64. A biasing spring 66 biases bail 60 inwardly into cavity to retract retention members 64 into the end 26 or 28 of selector receiver 20. While this alternative structure is shown only on left end 26 of selector receiver 20, identical structure is also used on right end 28 of selector receiver 20.

With bail 62 biased inwardly and retention members 64 retracted, the user is free to insert or remove hand grip 22 from selector receiver 20. However, to retain hand grip 22 in selector receiver, a user rotatable knob 68 carried on left end 26 or right end 28 can be rotated approximately 180° to cause a cam surface 70 affixed to knob 68 to push bail 62 outwardly in the cavity in which it is received against the bias of spring 66 as shown by the arrow E in FIG. 8. This will extend retention members 64 into an inwardly projected position overlying the upper edge of the associated left end wall 32 or right end wall 34 of hand grip 22 as the case may be. The inward projection of retention members 64 will capture or clamp hand grip 22 between the retention members 64 and the bottom 29 of selector receiver as was true of retention lips 52 on connector 46.

Figure 9:
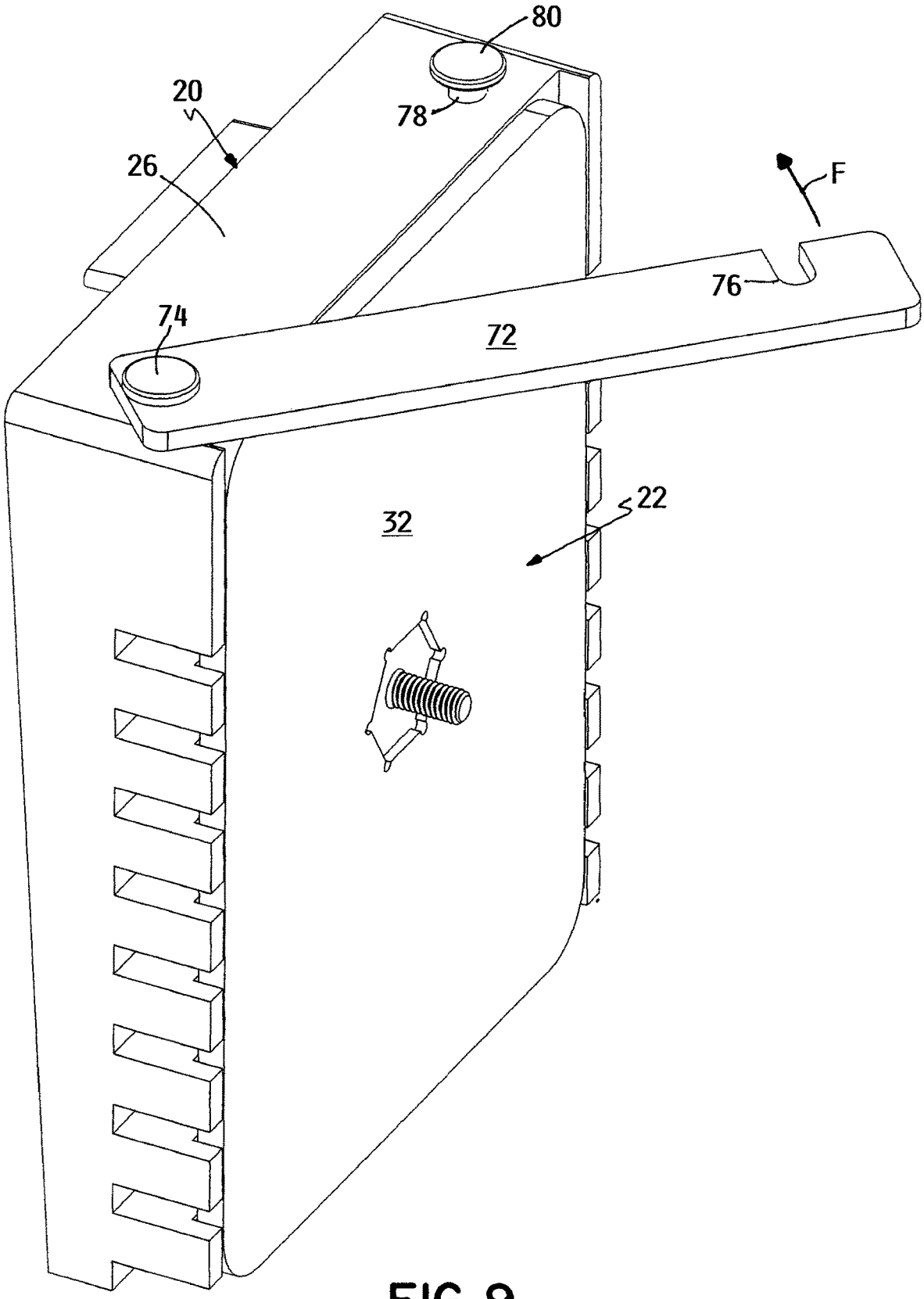
FIG. 9 is a perspective view of a third embodiment of a structure for securing the selector receiver and the hand grip of the handle together.

FIG. 9 discloses a third embodiment of the securing structure for joining hand grip 22 to selector receiver 20. In this alternative, each end 26, 28 of selector receiver 20 carries a retention bar 72 that is pivotally attached at one end by a pivot 74 to the upper face of each end 26, 28. The other end of retention bar 72 has a slot 76 that is adapted to have a snap fit to a shank 78 of a pin 80 fixed to the other end of the upper face of each end 26, 28. Bars 72 are unsnapped from pin 80 and swung out of the way to allow insertion of hand grip 22 into selector receiver 20. After such insertion, each bar 72 is then pivoted in the direction of the arrow F in FIG. 9 until slot 76 snap fits onto shank 78 of pin 80. When so secured, the innermost portion of bar 72 will closely overlie the upper edges of the left and right end walls 32, 34 of hand grip 22 to function retention lips 52 on connector 46 to capture or clamp hand grip 22 to selector receiver 20.

Figure 5:
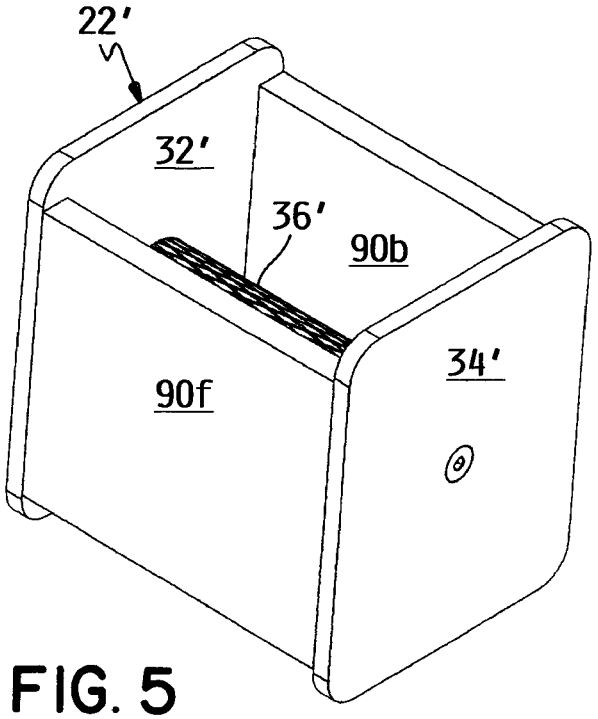
FIG. 5 is a perspective view of an alternative form of the hand grip of the handle.
Figure 6:
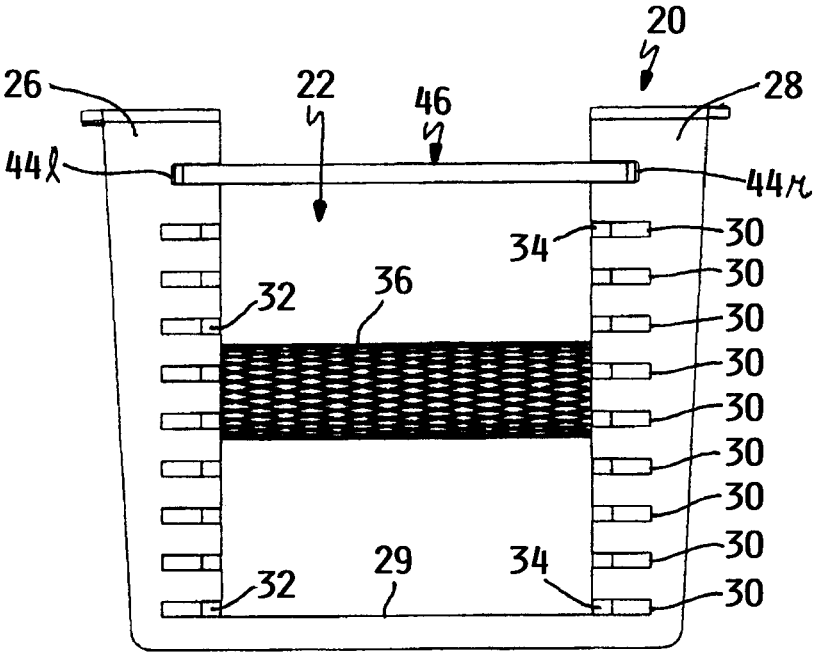
FIG. 6 is a side elevational view of one embodiment of a structure for securing the selector receiver and the hand grip of the handle together.

Finally referring now to FIG. 5, a second embodiment of hand grip is referred to generally as 22', with the prime designation denoting components that are the same as in hand grip 22. Thus, hand grip 22' includes the same end left and right end walls 32', 34' joined together by a grip member 36'. Hand grip 22' differs from hand grip 22 in that it additionally includes front and rear weight plates 90*f*, 90*b* which are fixed, e.g. by welding or the like, to the front and rear sides, respectively, of left and right end walls 32', 34'. This increases the weight of hand grip 22' as compared to the weight of hand grip 22 by the added mass of weight plates 90*f*, 90*b*. Despite the presence of the additional weight plates 90*f*, 90*b* to hand grip 22', hand grip 22' functions identically to hand grip 22 in how it is inserted into weight selector 20, in how it telescopically fits into open interior 41 of weight selector 24 to have the abutting dislodgement preventing interface therewith, and in how it is secured to weight selector 20.

The purpose of hand grip 22' is to be able to incrementally increase the weight of hand grip 22 in relatively small amounts, e.g. by two and a half pounds, that fall within the larger increments of weight change that are provided by each additional nested weight 4. For example and leaving out the mass provided by weight selector 20 in this example, assume that hand grip 22 weighs five pounds and that each weight 4 is sized to provide another five pounds. Thus, the user when using hand grip 22 by itself will have a five pound dumbbell whose weight can be progressively increased to 50 pounds by successively and progressively adding the nine weights 4 to hand grip 22. If hand grip 22' is also available to the user in addition to hand grip 22 with the user having purchased hand grip 22' as well or gotten both hand grips 22 and 22' as part of a purchase of dumbbell 2, using hand grip 22' instead of hand grip 22 allows the user to adjust the exercise weight in a jump of only two and a half pounds. This would allow the user to exercise at 7.5 pounds with hand grip 22' alone, at 12.5 pounds with one weight 4 attached to hand grip 22', at 17.5 pounds with two weights 4 attached to hand grip 22', and so on.

Various other modifications will be apparent to those skilled in the art. For example, weight selector 24 preferably is a single weight selector. However, weight selector 24 could alternatively be split into two separate left and right weight selectors each having an inwardly facing U-shape. The base of the U-shaped left weight selector would be slidably received in the horizontal left slot 30 of a selected pair of slots 30 with the legs of the U-shape extending horizontally inwardly to form the dislodgement preventing interface with the vertical front and rear edges of left end wall 32 of hand grip 22. Similarly, the base of the U-shaped right weight selector would be slidably received in the horizontal right slot 30 of the same selected pair of slots 30 with the legs of the U-shape extending horizontally inwardly to form the dislodgement preventing interface with the vertical front and rear edges of the right end wall 34 of hand grip 22. When both left and right weight selectors are installed, the legs of their respective U-shapes could substantially meet or be closely adjacent to one another in the middle or alternatively could be spaced apart from one another by a few inches. Such a split selector would function like the embodiments of the single weight selector 24 described previously herein, but would require that the separate left and right selectors be individually installed and/or removed.

Thus, the scope of this invention will be limited only by the appended claims.

The invention claimed is:

1. A selectorized dumbbell, which comprises:
(a) a plurality of nested weights that provide a stack of left weight plates and a stack of right weight plates;
(b) a handle located between the the stack of left weight plates and the stack of right weight plates, the handle comprising:
(i) a selector receiver;
(ii) a hand grip that is separate from the selector receiver; and
(iii) a securing structure for selectively and releasably joining the selector receiver and the hand grip together to act as a unit;
(c) at least one weight selector that is movable into one selected position chosen from among a plurality of different possible positions on the selector receiver to thereby couple a selected number of the weights to the handle, wherein the plurality of different possible positions comprises a plurality of vertically spaced positions on the selector receiver, wherein the selector receiver has a substantially horizontal slot at each of the vertically spaced positions with a first portion of the at least one weight selector being slidable into a selected slot to install the at least one weight selector in the selected slot and the first portion being slidable out of the selected slot to remove the at least one weight selector from the selected slot, wherein the slots at each of the vertically spaced positions comprise an array of slots extending over a predetermined height on the selector receiver; and
(d) the hand grip and the at least one weight selector having an abutting interface therebetween that prevents dislodgement of the at least one weight selector from the selector receiver after the at least one weight selector is placed into the one selected position on the selector receiver and the hand grip is subsequently joined to the selector receiver by selective operation of the securing structure.

2. The dumbbell of claim 1, wherein the first portion of the at least one weight selector has a laterally extending portion adjacent one end thereof, the abutting interface between the hand grip and the at least one weight selector comprising a surface on the hand grip that comes into contact with the laterally extending portion of the at least one weight selector in the event the at least one weight selector attempts to slide out of the selected slot to thereby prevent dislodgement of the at least one weight selector.

3. The dumbbell of claim 2, wherein the surface on the hand grip that comes into contact with the laterally extending portion of the at least one weight selector extends vertically over the predetermined height of the array of slots to provide the abutting interface with the at least one weight selector no matter which slot in the array of slots receives the at least one weight selector.

4. The dumbbell of claim 2, wherein the surface on the hand grip that comes into contact with the laterally extending portion of the at least one weight selector is substantially adjacent to the laterally extending portion of the at least one weight selector when the at least one weight selector is installed in the selected slot.

5. The dumbbell of claim 2, wherein the surface on the hand grip that comes into contact with the laterally extending portion of the at least one weight selector is a vertical edge of a vertically extending wall on the hand grip.

6. A selectorized dumbbell, which comprises:
(a) a plurality of nested weights that provide a stack of left weight plates and a stack of right weight plates;
(b) a handle located between the stack of left weight plates and the stack of right weight plates, the handle comprising:
(i) a selector receiver;
(ii) a hand grip that is separate from the selector receiver; and
(iii) a securing structure for selectively and releasably joining the selector receiver and the hand grip together to act as a unit;
(c) at least one weight selector that is movable into one selected position chosen from among a plurality of different possible positions on the selector receiver to thereby couple a selected number of the weights to the handle;
(d) the hand grip and the at least one weight selector having an abutting interface therebetween that prevents dislodgement of the at least one weight selector from the selector receiver after the at least one weight selector is placed into the one selected position on the selector receiver and the hand grip is subsequently joined to the selector receiver by selective operation of the securing structure, and wherein a portion of the hand grip telescopically fits into an opening in the at least one weight selector to form the abutting interface.

7. A selectorized dumbbell, which comprises:
(a) a plurality of nested weights that provide a stack of left weight plates and a stack of right weight plates;
(c) a handle located between the stack of left weight plates and the stack of right weight plates, the handle comprising:
(i) a selector receiver;
(ii) a hand grip that is separate from the selector receiver; and
(iii) a securing structure for selectively and releasably joining the selector receiver and the hand grip together to act as a unit;
(c) at least one weight selector that is movable into one selected position chosen from among a plurality of different possible positions on the selector receiver to thereby couple a selected number of the weights to the handle;
(d) the hand grip and the at least one weight selector having an abutting interface therebetween that prevents dislodgement of the at least one weight selector from the selector receiver after the at least one weight selector is placed into the one selected position on the selector receiver and the hand grip is subsequently joined to the selector receiver by selective operation of the securing structure, and
(e) wherein the at least one weight selector comprises a single weight selector having an open interior that is vertically accessible from above when the weight selector is received in the selected position in the selector receiver, and wherein the hand grip comprises spaced left and right end walls which are joined together by a grip member with the end walls of the hand grip telescopically fitting into the open interior of the weight selector to form the abutting interface after the hand grip is dropped down into the open interior of the weight selector from above.

8. The dumbbell of claim 7, wherein the hand grip rests atop a bottom of the selector receiver after the hand grip is dropped down into the open interior of the weight selector.

9. The dumbbell of claim 7, wherein the weight selector comprises left and right side walls joined by front and back walls that form a substantially continuous periphery around the open interior of the weight selector, and wherein front and rear edges of the left and right end walls of the hand grip are substantially adjacent to the front and back walls, respectively, of the weight selector after the hand grip is dropped down into the open interior of the weight selector.

10. A selectorized dumbbell, which comprises:

(a) a plurality of nested weights that provide a stack of left weight plates and a stack of right weight plates;

(d) a handle located between the stack of left weight plates and the stack of right weight plates, the handle comprising:

(i) a selector receiver;

(ii) a hand grip that is separate from the selector receiver; and (iii) a securing structure for selectively and releasably joining the selector receiver and the hand grip together to act as a unit;

(c) at least one weight selector that is movable into one selected position chosen from among a plurality of different possible positions on the selector receiver to thereby couple a selected number of the weights to the handle;

(d) the hand grip and the at least one weight selector having an abutting interface therebetween that prevents dislodgement of the at least one weight selector from the selector receiver after the at least one weight selector is placed into the one selected position on the selector receiver and the hand grip is subsequently joined to the selector receiver by selective operation of the securing structure, and (e) wherein the selector receiver comprises a left end, a right end that is spaced from the left end, and a bottom that interconnects the left and right ends, wherein inside surfaces of the left and right ends of the selector receiver have identical arrays of vertically spaced, inwardly opening, horizontal slots which form the plurality of different possible positions in which the at least one weight selector may be received, and wherein the hand grip comprises spaced left and right end walls which are joined together by a grip member with the end walls of the hand grip resting atop the bottom of the selector receiver after the hand grip is dropped into the selector receiver.

11. The dumbbell of claim 10, wherein the left and right end walls of the hand grip have upper edges that are positioned above the arrays of slots in the left and right ends of the selector receiver after the hand grip is dropped down into the open interior of the weight selector as the hand grip rests atop the bottom of the selector receiver.

12. The dumbbell of claim 11, wherein the securing structure is located on the left and right ends of the selector receiver above the arrays of slots in the left and right ends of the selector receiver.

13. The dumbbell of claim 12, wherein the securing structure acts on the upper edges of the left and right end walls of the hand grip to capture or clamp the hand grip between the securing structure and the bottom of the selector receiver.

14. The dumbbell of claim 13, wherein the securing structure comprises:

(a) an inwardly facing connection slot on an upper portion of the left end of the selector receiver and a corresponding inwardly facing connection slot on an upper portion of the right end of the selector receiver, and (b) at least one connector that is slid into each connection slot to be installed in each connection slot and when so installed provides a left retention lip that overlies the upper edge of the left wall of the hand grip and a right retention lip that overlies the upper edge of the right wall of the hand grip to retain the hand grip between the two retention lips and the bottom of the selector receiver.

15. The dumbbell of claim 14, wherein the at least one connector that is slid into each connection slot comprises opposite left and right sides of a four sided connector which has a substantially continuous periphery that substantially encloses an open interior of the connector.

16. The dumbbell of claim 15, wherein during unintended dislodgement of the connector during exercise activities using the dumbbell, a portion of the connector's periphery is configured to contact a portion of a user's hand, wrist or forearm on an arm the user is using to grip the grip member to stop further dislodgement of the connector.

17. The dumbbell of claim 14, wherein the at least one connector that is slid into each connection slot has a friction retainer acting against each connection slot to resist dislodgement of the at least one connector.

18. The dumbbell of claim 10, wherein the left and right end walls of the hand grip are substantially adjacent to the inside surfaces of the left and right ends of the selector receiver as the hand grip rests atop the bottom of the selector receiver.

19. A selectorized dumbbell, which comprises:

(a) a plurality of nested weights that provide a stack of left weight plates and a stack of right weight plates;

(b) a handle located between the stack of left weight plates and the stack of right weight plates, the handle comprising:

(i) a selector receiver;

(ii) a hand grip that is separate from the selector receiver; and (iii) a securing structure for selectively and releasably joining the selector receiver and the hand grip together to act as a unit;

(c) at least one weight selector that is movable into one selected position chosen from among a plurality of different possible positions on the selector receiver to thereby couple a selected number of the weights to the handle;

(d) the hand grip and the at least one weight selector having an abutting interface therebetween that prevents dislodgement of the at least one weight selector from the selector receiver after the at least one weight selector is placed into the one selected position on the selector receiver and the hand grip is subsequently joined to the selector receiver by selective operation of the securing structure, and (e) wherein the at least one weight selector after being placed into the one selected position on the selector receiver is bi-directionally removable from the one selected position when the hand grip is separated from the selector receiver.

* * * * *